US011321991B1

(12) United States Patent
Lin

(10) Patent No.: US 11,321,991 B1
(45) Date of Patent: May 3, 2022

(54) GAME TREND DISPLAY SYSTEM

(71) Applicant: He Lin, Las Vegas, NV (US)

(72) Inventor: He Lin, Las Vegas, NV (US)

( * ) Notice: Subject to any disclaimer, the term of this patent is extended or adjusted under 35 U.S.C. 154(b) by 0 days.

(21) Appl. No.: 16/026,041

(22) Filed: Jul. 2, 2018

Related U.S. Application Data

(60) Provisional application No. 62/527,931, filed on Jun. 30, 2017.

(51) Int. Cl.
*G07F 17/32* (2006.01)
*G06Q 50/34* (2012.01)
*A63F 1/00* (2006.01)

(52) U.S. Cl.
CPC ..... *G07F 17/3211* (2013.01); *G06Q 50/34* (2013.01); *G07F 17/3293* (2013.01); *A63F 2001/001* (2013.01)

(58) Field of Classification Search
CPC .... G07F 17/3211; G07F 17/322; G07F 17/32; G07F 17/323; G07F 17/3239; G07F 17/3244; G07F 17/3206; G07F 17/3209; G07F 17/3225; G07F 17/3237; G07F 17/3241; G07F 17/3288; G07F 17/3293; G07F 17/3262; A63F 1/18; A63F 2001/008; A63F 3/00157; A63F 5/00; G06Q 50/34
See application file for complete search history.

(56) References Cited

U.S. PATENT DOCUMENTS 6,217,447 B1 * 4/2001 Lofink ..... A63F 1/18 273/292
2001/0031659 A1 * 10/2001 Perrie ..... A63F 3/00075 463/18
2005/0032570 A1 * 2/2005 Ohira ..... A63F 5/00 463/17
2007/0075490 A1 * 4/2007 Gak ..... A63F 3/00157 273/146
2008/0214270 A1 * 9/2008 Kido ..... G07F 17/3244 463/17
2009/0143141 A1 * 6/2009 Wells ..... G07F 17/32 463/37
2014/0094244 A1 * 4/2014 Baron ..... G07F 17/323 463/17

(Continued)

*Primary Examiner* — William H McCulloch, Jr.
*Assistant Examiner* — Ankit B Doshi
(74) *Attorney, Agent, or Firm* — Newman Law, LLC

(57) ABSTRACT

A system for providing a gaming trend display at a gaming table comprising a processing device, memory and a display device for displaying historical Baccarat game outcomes in one or more predefined formats stored in memory, the systems and methods comprising a data communication device for detecting a new game outcome, the processing device converting the new game outcome for display in the one or more predefined formats on the display device and responsive to updating the display device with the new game outcome, activating the display of an illustrative game outcome in the one or more predefined formats, wherein the illustrative game outcome has the display characteristics of being visually distinguishable from the historical game outcomes, and wherein the illustrative game outcome display is deactivated responsive to receiving a new game outcome detected by the data communication device.

1 Claim, 3 Drawing Sheets

(56) References Cited

U.S. PATENT DOCUMENTS

| | | | | |
|---|---|---|---|---|
| 2015/0087370 | A1* | 3/2015 | Hematji Rajput .. | G07F 17/3211 463/11 |
| 2016/0180633 | A1* | 6/2016 | Yamaguchi ..... | G07F 17/322 463/31 |

* cited by examiner

GAME TREND DISPLAY SYSTEM

CROSS REFERENCE TO RELATED APPLICATION(S)

This application claims the benefit of U.S. Provisional Patent Application No. 62/527,931 which was filed Jun. 30, 2017, the disclosure of which is incorporated herein by reference.

BACKGROUND OF THE INVENTION

Field of the Invention

The present invention relates to the field of gaming, particularly to the field of wagering games involving real or virtual playing cards, and more particularly to display systems for use with wagering games.

Background of the Art

Baccarat is a popular card game that is offered for play by most casinos. The game itself may take various forms, such as a live or simulated electronic table game, or it can be an online game. Randomly generated cards or simulations thereof are dealt to form a banker hand and a player hand. Prior to the deal, each better can make one of three wagers: 1) that the banker hand will win; 2) that the player hand will win; or 3) that the banker hand and the player hand will tie. The winning hand is the hand that has a score that is closest to a total on nine according to the Baccarat scoring rules.

The bettor receives even money for the wager if the winning hand is selected and loses the wager if the losing hand is selected. However, the rules of play of conventional Baccarat, and more particularly, the pre-established draw rules, result in the banker hand having a slightly higher chance of winning than the player hand. Therefore, if the bettor wagers on the banker hand and the banker hand wins, the bettor must pay to the gaming establishment a commission of typically 5% of the amount the bettor wins. No commission is paid if the bettor successfully wagers on the player hand. A tie may result in a greater payout than even money.

There are variations of Baccarat offered for play in various forms, including versions in which the game has been modified to eliminate the commission requirement.

To facilitate the play of live Baccarat, groups of six to eight decks of randomly-ordered standard playing cards are placed in a card dealing shoe, which will be periodically refilled with a new group of six to eight decks of randomly-ordered cards as needed. Bettors playing Baccarat like to track the outcomes of hands of play, particularly when starting with the first game outcome out of a new shoe of cards. The tracking of game outcomes may be significant to the bettor, as the recordation of the historical outcomes of each hand is believed to indicate the future outcomes for the remaining hands to be dealt from the shoe.

It is known for bettors to notate on paper a running record of the outcomes of hands. By keeping a running record player hand wins, banker hand wins and ties, the bettor may perceive tendencies to help them decide how to wager on the next hand. For example, if the banker hand has won five consecutive hands, the bettor may decide to wager on the player hand on the next deal perceiving that the player hand is due to win. Conversely the bettor may determine that it is best to go with the winning streak and wager on the banker hand. Thus, many players attribute great significance to the historical outcomes of a shoe in Baccarat and use that information to develop strategies in deciding how and when to make a wager.

In light of such player tendencies, most casinos provide a simple electronic display which may indicate the last 20 or more game outcomes.

U.S. Pat. No. 6,217,447 to Lofink, et al., describes a method and system for generating displays related to the play of Baccarat. Cards dealt to each of the banker and player hands are identified by scanning and data signals are generated. The card identification data signals are processed to determine the outcome of the hand. The outcome of the hand and historical records of prior outcomes are displayed on a video display. The Lofink patent is incorporated herein by reference in its entirety as part of the enabling disclosure for such elements as apparatus, methods, hardware and software.

Baccarat players have been known to use various configurations of game outcome information converted to simple colored markers or symbols to create specific types of easy to read displays of historical outcomes. However, prior to the present invention, no display depicted the occurrence of a potential game outcome so that players could easily visualize the characteristics of the display if that potential game outcome was the actual game outcome. The present invention is therefore needed in the art at least because of the strong demonstrated interest in using historical information to make wagering decisions in the game of Baccarat.

SUMMARY OF THE INVENTION

Some embodiments of the invention are directed to systems and methods which include a processing device, memory and a display device for displaying historical Baccarat game outcomes in one or more predefined formats stored in memory, the systems and methods comprising a data communication device for detecting a new game outcome, the processing device converting the new game outcome for display in the one or more predefined formats on the display device and responsive to updating the display device with the new game outcome, activating the display of an illustrative game outcome in the one or more predefined formats, wherein the illustrative game outcome has the display characteristics of being visually distinguishable from the historical game outcomes, and wherein the illustrative game outcome display is deactivated responsive to receiving a new game outcome detected by the data communication device.

BRIEF DESCRIPTION OF THE DRAWINGS

While the disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION OF THE INVENTION

It should be understood that the invention is generally directed to systems, methods and apparatus for operating, hosting and conducting wagering games generally involving sequences of controlled and concrete transformative events or steps, the generation of random results or data, and the use and application of the randomly generated results in a manner which provides for the resolution of both prior and/or subsequent events or steps, as well as the display of historical outcomes from such games and using game trend displays to aid in further wagering by players.

Figure 1:
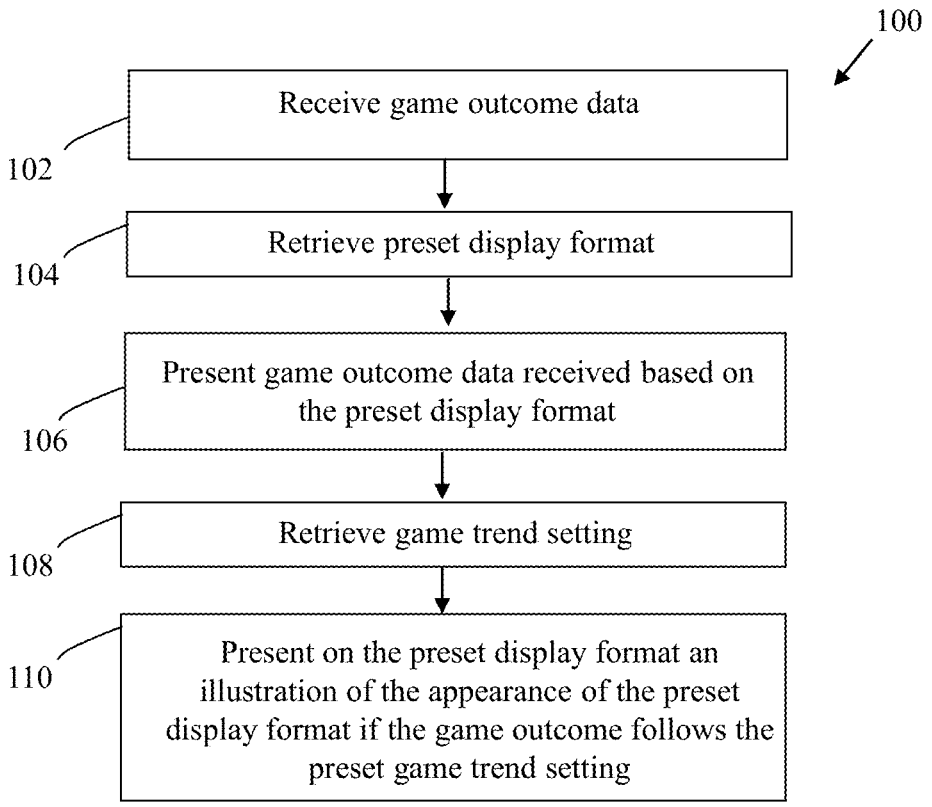
FIG. 1 is a process flow chart depicting an exemplary method of operating the game trend display system of the invention according to some embodiments of the invention.

FIG. 1 provides an exemplary embodiment of the invention for providing a method generally referred to by the reference numeral 100. In step 102, game outcome data from an round or an instance of game play is received, such as by a data communication device. Game outcome data may include any information relating to the outcome of a game, such as the winning hand in poker or a poker variant or numbers in blackjack or roulette for example. In the case of Baccarat, the game outcome data may include the number of cards in the player and/or banker hand, the winning hand or whether there was a tie. In step 104, the system retrieves the preset or preprogrammed display format such as from a database or memory. Examples of preset display formats for Baccarat are discussed herein below. In step 106, the appropriate display of the game outcome data received based on the preset display format is determined by a processing device and presented accordingly on the preset display format on a display device. The display device may be a LCD screen mounted adjacent to a gaming table or a mobile device or tablet screen, In step 108, a game trend setting is retrieved from memory and the processor determines based on the game trend setting the appropriate display of the next possible game outcome based on the preset display format as shown by step 110.

The game trend setting may be any predicted result or outcome possible in the game outcome data associated or generated from the next instance of game play. For example, in the case of roulette, the game trend setting may be that the next outcome will always be a red number. The game trend setting may be random or based on probability or fixed, such as in Baccarat the game trend outcome may be fixed on Banker win being the next game outcome. In some embodiments, the display of the game trend outcome is presented in a manner which makes it identifiable as the game trend outcome, that is, different from the prior instances of game play resulting in game outcome data, at least so that viewers are aware that the game trend outcome data does not represent actual game results. For example, different colors or flashing indicators may be used to differentiate the predicted game trend outcome data from the actual game outcome results already displayed.

It should be understood that steps in FIG. 1 are shown as being independent or combined for illustrative purposes and that any of the steps shown as independent may be combined, and those shown as combined may be independent, all in accordance with the invention.

Some embodiments of the invention are directed to systems and methods which include a processing device, memory and a display device for displaying historical Baccarat game outcomes in one or more predefined formats stored in memory, the systems and methods comprising a data communication device for detecting a new game outcome, the processing device converting the new game outcome for display in the one or more predefined formats on the display device and responsive to updating the display device with the new game outcome, activating the display of an illustrative game outcome in the one or more predefined formats, wherein the illustrative game outcome has the display characteristics of being visually distinguishable from the historical game outcomes, and wherein the illustrative game outcome display is deactivated responsive to receiving a new game outcome detected by the data communication device.

In some embodiments, groups of cards are shuffled and loaded into a dealing shoe for dealing to the bettors playing the live game. The dealing shoe or table may include a card reading device, which may include a camera or scanner, in communication with a processor and memory. Bettors place wagers on the Player hand, Banker hand and ties.

As the dealer deals cards from the shoe they are each passed over the card reading device to be read before being positioned in the appropriate hand areas for the player or banker hands. Since the cards are dealt in strict sequence, such as, first card to the player hand, next card to the banker hand, next card to the player hand and next card to the banker hand, the data signals generated by the card reader are processed to determine the identity of each card in the player and banker hands. The processor uses the card identity in the player and banker hands to determine the player and banker score, and whether additional cards are to be dealt according to the rules of Baccarat. Ultimately, all cards in the player and banker hands are identified and the game outcome based thereon and the game rules stored in memory is determined.

The processor is linked to a display device driver which is in turn linked to a display. The game outcome is used to update the symbols used in the display of historical game outcomes according to the one or more preprogrammed preset formats for arranging the historical game outcomes on the display device, such as those discussed herein below. For example, a game outcome may be converted to a symbol which has characteristics or features, such as a color, identifying the outcome as either player hand win, banker hand win or tie.

In some embodiments, the card reading device is located in the card shoe and data signals are automatically communicated to the processing device. In other embodiments, each card identity or the game outcome is manually entered into a display device interface or keypad in communication with the display device.

Subsequent to each update of a new game outcome to the display of historical game outcome information in the preprogrammed formats, the processor further updates the display of the historical game outcome information in the preprogrammed formats with an illustrative game outcome. The illustrative game outcome includes a visual indication displayed on the display device that distinguishes it from the historical game outcomes so that viewers are made aware that the illustrative game outcome is not an actual game outcome. While not being limited to any particular visually distinguishable feature or characteristic, some embodiments may use a different color or symbol from those used to identify historical game outcomes. In other embodiments, the symbols may be the same as the historical game outcomes but made to appear intermittently, that is, flashing.

In some embodiments, an indication of whether the illustrative game outcome is a player hand win, banker hand win or tie is randomly selected and shown on the display device. In some embodiments, the illustrative game outcome is always one of either a player hand win, a banker hand win or a tie. In some embodiments, the illustrative game outcome is always a banker hand win.

It should be readily apparent the systems and methods of the invention are therefore used to illustrate the appearance of the display as it would look if the next game outcome was the same as the illustrative game outcome. For example, in the embodiments in which the illustrative game outcome is always a banker hand win, the display will always depict its appearance if the next game outcome is a banker hand win. Players use this depiction to make a wagering decision in that they may foresee a trend resulting from the illustrative game outcome which they believe will continue.

Various preprogrammed preset formats for arranging historical Baccarat game outcomes may be displayed in accordance with this invention so long as the illustrative game outcome is displayed with a visually distinguishing feature as compared with the actual or historical game outcomes. Examples of displays which may be incorporated in a single display with multiple regions or multiple display devices are described below.

Figure 2:
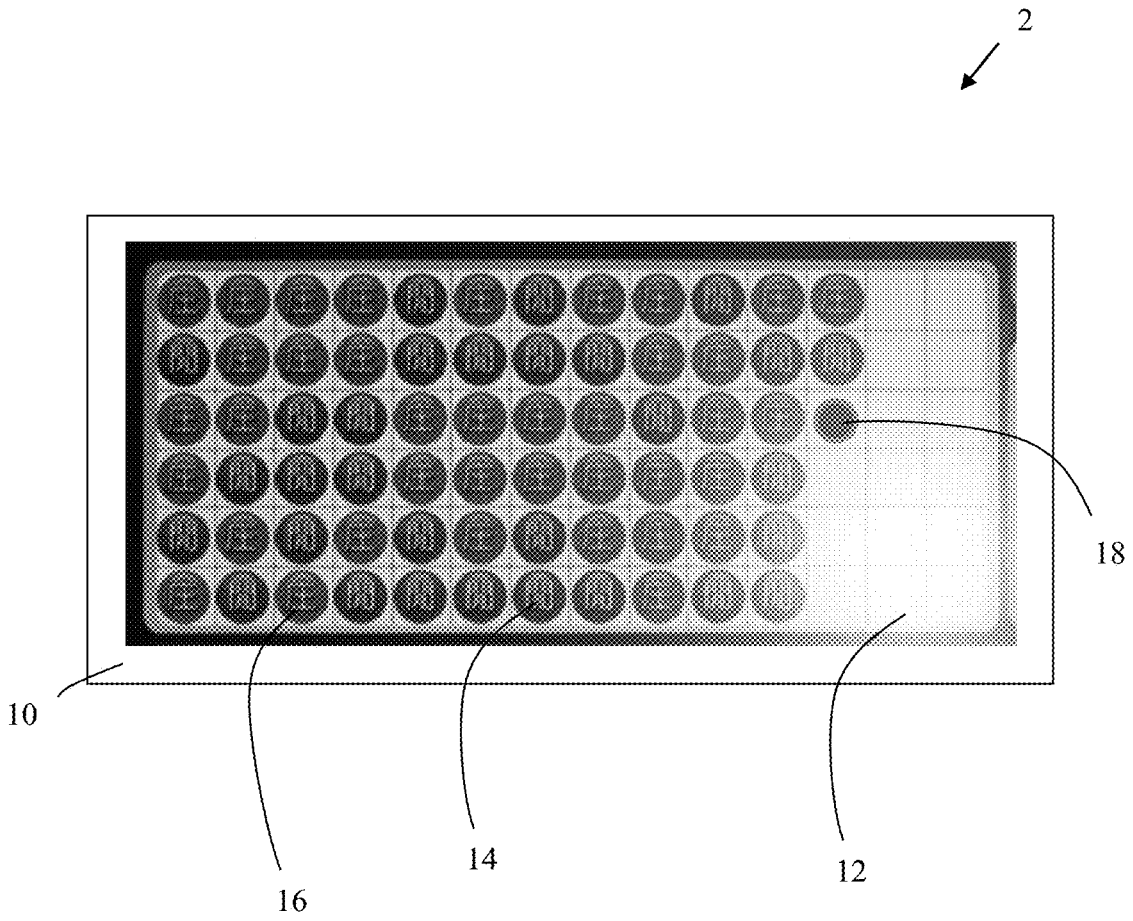
FIG. 2 illustrates a preprogrammed or preset display format for use with at least one embodiment of the invention.

FIG. 2 illustrates a display 2 for display on a display device 10 according to a preprogrammed format for displaying Baccarat game outcomes on a grid 12 referred to as the "bead plate." Player, Banker, and Tie wins are recorded as follows a blue marker 14 on the grid display 12 indicates a player win, a red marker 16 on grid display 12 indicates a banker win and a green marker 18 on grid display 12 indicates a tie. The display of game outcomes starts in the upper left hand corner and continues downward in the same column. When the bottom row on grid 12 is reached, the outcomes displayed continues by moving over to the top of the column to the right and working downward again.

Figure 3:
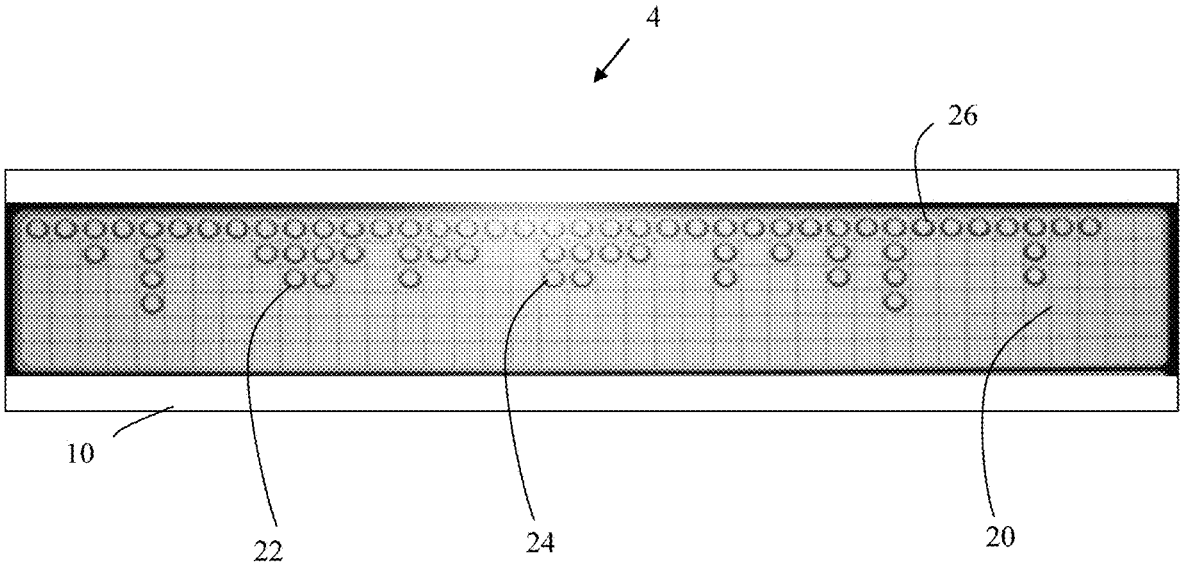
FIG. 3 illustrates another preprogrammed or preset display format for use with at least one embodiment of the invention.

FIG. 3 illustrates another display 4 of a preprogrammed format 20 for displaying Baccarat game outcomes on a display device 10 called the "Big Road." This preset display format 20 primarily keeps track of Player wins 22 and Banker wins 24. Ties 26 are also noted with green circles or in some versions ties and pairs are noted with slashes and dots, respectively. To be specific, a tie is noted with a green line through the previous Player or Banker win. A Player pair is noted with a blue dot in the lower right corner of the hand it occurred in. A Banker pair with a red dot in upper left. In the interest of simplicity, in this example there were only Player and Banker wins. Much like in the Bead Plate of FIG. 2, the game outcomes displayed starts in the upper left of format 20, as well as marking Player wins in blue, and Banker wins in red. However, instead of a solid circle, with a Chinese character in the middle, the Big Road has only the blue and red outlines of circles. Unlike the Bead Plate, in the Big Road the player starts at the top of a new column with each change in Player and Banker winning. Note the grid is six rows deep. In the event there are seven or more consecutive Player or Banker wins, the results will move to the right, creating what is known as a dragon tail. In this example that never happens, as there was never more than four consecutive wins on the same side.

Figure 4:
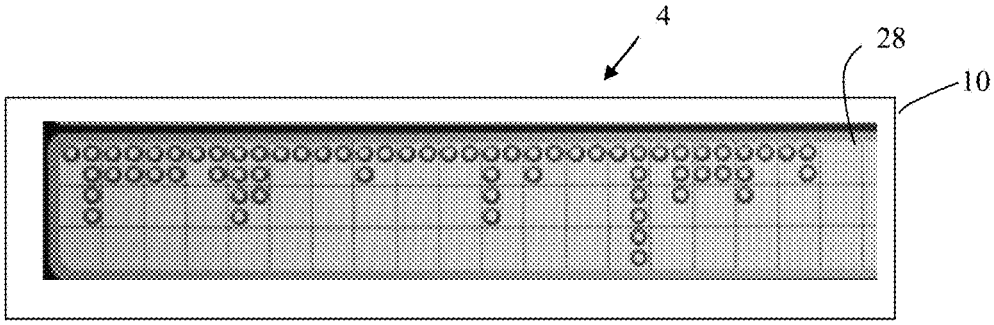
FIG. 4 illustrates yet another preprogrammed or preset display format for use with at least one embodiment of the invention.

FIG. 4 illustrates a display 6 of another preprogrammed format 28 for displaying game outcomes pictured above is known as the Big Eye Boy. The Big Eye Boy table is useful in gauging how repetitive the shoe is. Red entries are a sign of repetition, and blue entries are a sign of a chaotic, "choppy" shoe. It is important to note that in the Big Eye Boy table, blue and red are not associated with Player and Banker wins, as they are on the previous two tables. The first entry in the Big Eye Boy table is the hand after the first entry in the second column of the Big Road, so that there is enough information to judge if a pattern is developing or not. Every entry in the Big Eye Boy table, as refers to a specific entry in the Big Road. Each entry in the Big Eye Boy is recorded as follows: if the hand in question causes a new column in the Big Road, then compare the previous two columns in the Big Road. If they are the same in depth, then record a red circle in the Big Eye Boy. If they are not, then record a blue circle; if the hand in question is the same outcome as the previous hand (skipping ties), then compare the cell to the left of the newly created entry in the Big Road with the cell directly above that one. If these two cells are the same, whether both Player, both Banker, or both blank; then mark a red in the Big Eye Boy. Otherwise, mark a blue. In other words, consider the latest entry in the Big Road. Then, move one cell to the left. Then, move up. If the move up does not result in a change, mark red, if it does, mark blue.

Figure 5:
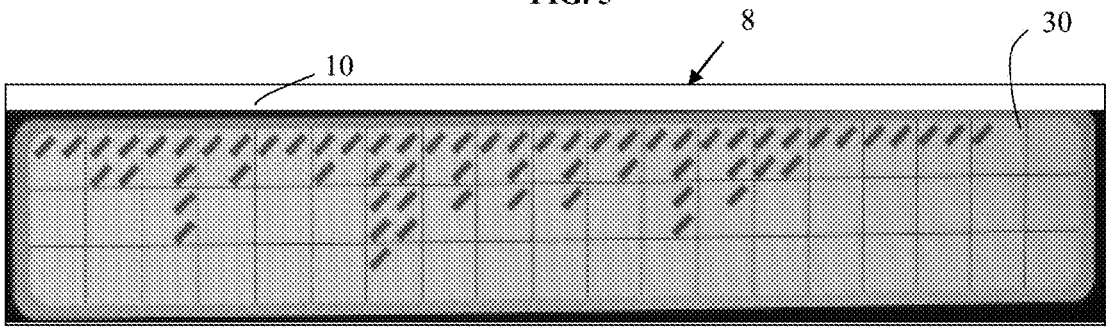
FIG. 5 illustrates yet another preprogrammed or preset display format for use with at least one embodiment of the invention.

FIG. 5 illustrates a display 8 of a preprogrammed format 30 in the bottom right of the display, is "Cockroach Pig." The Cockroach works skips two columns to the left of the current column in the Big Road. To have enough information to go on, the Cockroach Pig must wait until the entry after the first entry in the fourth column of the Big Road. Here is exactly how the Cockroach Pig is recorded: if the hand in question causes a new column in the Big Road then compare the first and fourth columns to the left of the new column in the Big Road. If they are the same in depth, then record a red circle in the Cockroach Pig. If they are not, then record a blue circle; if the hand in question is the same outcome as the previous hand (skipping ties), then compare the cell three cells to the left of the newly created entry in the Big Road with the cell directly above that one. If these two cells are the same, whether both Player, both Banker, or both blank; then mark a red in the Cockroach Pig. Otherwise, mark a blue. In other words, consider the latest entry in the Big Road. Then, move three cells to the left. Then, move up. If the move up does not result in a change, mark red, if it does, mark blue.

The illustrative game outcome would be depicted in each display in a manner that viewers would recognize the illustrative game outcome as not being an actual game outcome while also enabling viewers to visualize trends based on the illustrative game outcome being the actual game outcome. For example, a flashing red, blue or green marker would be displayed in the appropriate columns and rows of any or all of the formats shown in FIGS. 2-5.

In some embodiments, display systems in accordance with this disclosure may be administered using a gaming system employing a client-server architecture (e.g., over the Internet, a local area network, etc.).

Each of the methods and individual steps recited herein may be partially or wholly carried out in a variety of ways and/or systems, which may include, but are not limited to, a live dealer physically dealing or using gaming implements in a casino, an electronic gaming machine (EGM) or kiosk for one or more players in which a live dealer distributes or uses gaming implements, such as cards, which may be in combination with a mechanism such as a camera or sensors for determining game outcomes by processing the random results with a data processor, or gaming implements are provided through a program which may include a random number generator, standalone multiplayer platforms which may include a player interface such as a touchscreen display and a physical or virtual gaming implements, through a home computer or portable computing device, such as a tablet computer or mobile phone capable of communicating with a network or over the Internet, global telecommunication network or world wide web. Some embodiments of the invention are directed to systems for providing the above methods, which may include one or more data communication devices, display devices, and processing devices, which may be local or remote, as necessary to provide these methods on any computerized or partially computerized platforms, online or through a local or global communication network, including mobile devices, home computers, single or multiplayer electronic gaming machines enabling play with virtual or real currency and/or virtual or real playing cards, devices or kiosks for enabling wagering on the play of a live Baccarat game.

Some embodiments of the invention are also directed to a non-transitory machine readable media for providing a display system associated with an underlying game of Baccarat including one or more software programs, code and/or data segments as necessary to provide any of the methods described herein on one or more machines.

It should be understood that the words "wager," "wagering," "betting" or "bet," or the like, refers to any type of points, money, credits, items of value, including physical or virtual representations thereof, which are placed at stake in that they may be forfeit depending on the occurrence of machine-generated randomly generated outcomes, such as outcomes which may be provided by revealing physical playing cards drawn from one or more decks or groups of randomly-ordered physical playing cards or a random number generator for randomly generating numbers which can be mapped to identify playing card results.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system, gaming device, gaming machine or incorporated in an existing gaming system or machine. The system and gaming device of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality. However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," "determining," or the like, refer to the action and processes of a computer system, or similar electronic computing device (such as a specific computing machine), that manipulates and transforms data represented as physical (electronic) quantities within the computer system memories or registers or other such information storage, transmission or display devices.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for the purposes of enablement and best mode.

Those skilled in the art will appreciate that the types of software and hardware used are not vital to the full implementation of the methods of the invention. The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

While exemplary systems and methods, and applications of methods of the invention, have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Additional information regarding exemplary embodiments of the invention is provided below.

Computer Program

In some embodiments, the methods, systems, and media disclosed herein include at least one computer program, or use of the same. A computer program includes a sequence of instructions, executable in the digital processing device's CPU, written to perform a specified task. Computer readable instructions may be implemented as program modules, such as functions, objects, Application Programming Interfaces (APIs), data structures, and the like, that perform particular tasks or implement particular abstract data types. In light of the disclosure provided herein, those of skill in the art will recognize that a computer program may be written in various versions of various languages.

The functionality of the computer readable instructions may be combined or distributed as desired in various environments. In some embodiments, a computer program comprises one sequence of instructions. In some embodiments, a computer program comprises a plurality of sequences of instructions. In some embodiments, a computer program is provided from one location. In other embodiments, a computer program is provided from a plurality of locations. In various embodiments, a computer program includes one or more software modules. In various embodiments, a computer program includes, in part or in whole, one or more web applications, one or more mobile applications, one or more standalone applications, one or more web browser plug-ins, extensions, add-ins, or add-ons, or combinations thereof.

Web Application

In some embodiments, a computer program includes a web application. In light of the disclosure provided herein, those of skill in the art will recognize that a web application, in various embodiments, utilizes one or more software frameworks and one or more database systems. In some embodiments, a web application is created upon a software framework such as Microsoft® .NET or Ruby on Rails (RoR). In some embodiments, a web application utilizes one or more database systems including, by way of non-limiting examples, relational, non-relational, object oriented, associative, and XML database systems. In further embodiments, suitable relational database systems include, by way of non-limiting examples, Microsoft® SQL Server, mySQL™, and Oracle®. Those of skill in the art will also recognize that a web application, in various embodiments, is written in one or more versions of one or more languages. A web application may be written in one or more markup languages, presentation definition languages, client-side scripting languages, server-side coding languages, database query languages, or combinations thereof. In some embodiments, a web application is written to some extent in a markup language such as Hypertext Markup Language (HTML), Extensible Hypertext Markup Language (XHTML), or eXtensible Markup Language (XML). In some embodiments, a web application is written to some extent in a presentation definition language such as Cascading Style Sheets (CSS). In some embodiments, a web application is written to some extent in a client-side scripting language such as Asynchronous Javascript and XML (AJAX), Flash® Actionscript, Javascript, or Silverlight®. In some embodiments, a web application is written to some extent in a server-side coding language such as Active Server Pages (ASP), ColdFusion®, Perl, Java™, JavaServer Pages (JSP), Hypertext Preprocessor (PHP), Python™, Ruby, Tcl, Smalltalk, WebDNA®, or Groovy. In some embodiments, a web application is written to some extent in a database query language such as Structured Query Language (SQL). In some embodiments, a web application integrates enterprise server products such as IBM® Lotus Domino®. In some embodiments, a web application includes a media player element. In various further embodiments, a media player element utilizes one or more of many suitable multimedia technologies including, by way of non-limiting examples, Adobe® Flash®, HTML 5, Apple® QuickTime®, Microsoft® Silverlight®, Java™, and Unity®.

Mobile Application

In some embodiments, a computer program includes a mobile application provided to a mobile digital processing device. In some embodiments, the mobile application is provided to a mobile digital processing device at the time it is manufactured. In other embodiments, the mobile application is provided to a mobile digital processing device via the computer network described herein.

In view of the disclosure provided herein, a mobile application is created by techniques known to those of skill in the art using hardware, languages, and development environments known to the art. Those of skill in the art will recognize that mobile applications are written in several languages. Suitable programming languages include, by way of non-limiting examples, C, C++, C#, Objective-C, Java™, Javascript, Pascal, Object Pascal, Python™, Ruby, VB.NET, WML, and XHTML/HTML with or without CSS, or combinations thereof.

Suitable mobile application development environments are available from several sources. Commercially available development environments include, by way of non-limiting examples, AirplaySDK, alcheMo, Appcelerator®, Celsius, Bedrock, Flash Lite, .NET Compact Framework, Rhomobile, and WorkLight Mobile Platform. Other development environments are available without cost including, by way of non-limiting examples, Lazarus, MobiFlex, MoSync, and Phonegap. Also, mobile device manufacturers distribute software developer kits including, by way of non-limiting examples, iPhone and iPad (iOS) SDK, Android™ SDK, BlackBerry® SDK, BREW SDK, Palm® OS SDK, Symbian SDK, webOS SDK, and Windows® Mobile SDK.

Those of skill in the art will recognize that several commercial forums are available for distribution of mobile applications including, by way of non-limiting examples, Apple® App Store, Android™ Market, BlackBerry® App World, App Store for Palm devices, App Catalog for webOS, Windows® Marketplace for Mobile, Ovi Store for Nokia® devices, Samsung® Apps, and Nintendo® DSi Shop.

Standalone Application

In some embodiments, a computer program includes a standalone application, which is a program that is run as an independent computer process, not an add-on to an existing process, e.g., not a plug-in. Those of skill in the art will recognize that standalone applications are often compiled. A compiler is a computer program(s) that transforms source code written in a programming language into binary object code such as assembly language or machine code. Suitable compiled programming languages include, by way of non-limiting examples, C, C++, Objective-C, COBOL, Delphi, Eiffel, Java™, Lisp, Python™, Visual Basic, and VB .NET, or combinations thereof. Compilation is often performed, at least in part, to create an executable program. In some embodiments, a computer program includes one or more executable complied applications.

Software Modules

In some embodiments, the methods, systems, and media disclosed herein include software, server, and/or database modules, or use of the same. In view of the disclosure provided herein, software modules are created by techniques known to those of skill in the art using machines, software, and languages known to the art. The software modules disclosed herein are implemented in a multitude of ways. In various embodiments, a software module comprises a file, a section of code, a programming object, a programming structure, or combinations thereof. In further various embodiments, a software module comprises a plurality of files, a plurality of sections of code, a plurality of programming objects, a plurality of programming structures, or combinations thereof. In various embodiments, the one or more software modules comprise, by way of non-limiting examples, a web application, a mobile application, and a standalone application. In some embodiments, software modules are in one computer program or application. In other embodiments, software modules are in more than one computer program or application. In some embodiments, software modules are hosted on one machine. In other embodiments, software modules are hosted on more than one machine. In further embodiments, software modules are hosted on cloud computing platforms. In some embodiments, software modules are hosted on one or more machines in one location. In other embodiments, software modules are hosted on one or more machines in more than one location.

Databases

In some embodiments, the methods, systems, and media disclosed herein include one or more databases, or use of the same. In view of the disclosure provided herein, those of skill in the art will recognize that many databases are suitable for storage and retrieval of player and game information. In various embodiments, suitable databases include, by way of non-limiting examples, relational databases, non-relational databases, object oriented databases, object databases, entity-relationship model databases, associative databases, and XML databases. In some embodiments, a database is internet-based. In further embodiments, a database is web-based.

In still further embodiments, a database is cloud computing-based. In other embodiments, a database is based on one or more local computer storage devices.

General Information Relating to Various Embodiments of the Invention

A controller, computing device, or computer, such as described herein, may include at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

In some embodiments, a controller may include a processor, which as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system, gaming device, gaming machine or incorporated in an existing gaming system or machine. The gaming machine of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

Those skilled in the art will readily appreciate that the apparatus described herein may include various computer and network related software and hardware, such as programs, operating systems, memory storage devices, data input/output devices, data processors, servers with links to data communication systems, wireless or otherwise, and data transceiving terminals. Those skilled in the art will further appreciate that the precise types of software and hardware used are not vital to the full implementation of the apparatus of the invention so long as it performs as described in at least one of the embodiments herein.

While exemplary apparatus, systems and methods of the invention have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth by the claims and any equivalents thereto.

The invention claimed is:

1. A system for providing an automatically updated and secure Baccarat game trend displays in a closed loop Baccarat gaming table operation including a specially configured Baccarat gaming table display device mounted at a gaming table, the display device being dedicated for use with a live Baccarat game occurring at the gaming table, the display device being in communication with a playing card reading device positioned at the gaming table, the playing card reading device being adapted to identify playing cards as the playing cards are dealt in the live Baccarat game played at the gaming table, the system comprising:

a processing device and a memory in communication with a data communication device, the processing device being in communication with the card reading device to receive identities of playing cards dealt at the gaming table, the memory storing a plurality of predefined formats for displaying a plurality of actual historical Baccarat game outcomes, each predefined format of the plurality of predefined formats comprising a two-dimensional graphical representation of the Baccarat game play data, wherein the display device is divided into a plurality of display areas, the plurality of display areas being equal in number to the plurality of predefined formats, wherein each display area of the plurality of display areas including one predefined format of the plurality of predefined formats, the plurality of actual historical Baccarat game outcomes being determined by the processing device from Baccarat game play data received from the playing card reading device, wherein each actual historical Baccarat game outcome of the plurality of actual historical Baccarat game outcomes are determined by the processing device to be one of a Player win, Banker win or a Player-Banker tie; and the data communication device being in communication with the processing device and the card reading device installed at the gaming table to identify each playing card as a playing card is dealt from one or more decks of randomized playing cards, the processing device determining an actual new game outcome from the identification of each playing card and storing the actual new game outcome as game play data in the memory, wherein the determination of the actual new game outcome is independent of any outcome of a wager or the game play occurring at the live gaming table, and activates displaying on the display device the actual new game outcome in a format identifying the actual new game outcome as one of a Player win, Banker win or a Player-Banker tie, wherein the actual new game outcome is displayed in each predefined format of the plurality of predefined formats on the display device, wherein the processing device responsive to updating the display device with the actual new game outcome executes executable code stored in the memory, the executable code applying the actual new game outcome and the actual historical Baccarat game outcomes to determine an illustrative game outcome, wherein the illustrative game outcome is not based on any activity in the Baccarat game occurring at the gaming table, the illustrating game outcome being determined solely by the processing device as one of a Player win, Banker win or a Player-Banker tie based on a preset game trend setting stored in the memory, and wherein the processing device activates the display of the illustrative game outcome in each predefined format of the plurality of predefined formats on the display device, the illustrative game outcome being assigned by the processing device with one or more display characteristics stored in memory, the one or more display characteristics being visually distinguishable from the display on the display device of the actual new game outcome and the one or more actual historical Baccarat game outcomes in each predefined formats of the plurality of predefined formats displayed on the display device, the one or more display characteristics of the illustrative game outcome being one of a color, a symbol, or a flashing appearance, and wherein the processing device communicates with the display device to deactivate the display of the illustrative game outcome display responsive to the determination of a second actual new game outcome by the processing device, the second actual new game outcome being subsequently displayed on the display device in each predefined format of the plurality of predefined formats with a second illustrative game outcome.

* * * * *